US011529005B1

(12) United States Patent
Butler

(10) Patent No.: US 11,529,005 B1
(45) Date of Patent: Dec. 20, 2022

(54) SELF LEVELING PICTURE FRAME ASSEMBLY

(71) Applicant: Thomas Butler, Wisconsin Dells, WI (US)

(72) Inventor: Thomas Butler, Wisconsin Dells, WI (US)

( * ) Notice: Subject to any disclaimer, the term of this patent is extended or adjusted under 35 U.S.C. 154(b) by 0 days.

(21) Appl. No.: 17/565,539

(22) Filed: Dec. 30, 2021

(51) Int. Cl.
*A47G 1/06* (2006.01)

(52) U.S. Cl.
CPC ..... *A47G 1/06* (2013.01); *A47G 2001/0677* (2013.01); *A47G 2001/0694* (2013.01); *A47G 2400/086* (2013.01)

(58) Field of Classification Search
CPC ..... A47G 1/24; A47G 1/166; A47G 1/1626; A47G 40/713; A47G 2001/0694; A47G 2001/0677; A47G 1/06; A47G 2400/086
See application file for complete search history.

(56) References Cited

U.S. PATENT DOCUMENTS 586,120 A * 7/1897 Flynn ..... A47G 1/0616 40/713
1,944,203 A * 1/1934 Wittig ..... A47G 1/168 248/494
2,180,211 A * 11/1939 Kellogg ..... A47G 1/162 248/494
4,100,681 A * 7/1978 Hollander ..... G01C 9/24 33/389
4,212,123 A * 7/1980 Robin ..... A47G 1/16 40/713
4,244,549 A * 1/1981 Oldfield ..... A47G 1/24 248/494
4,449,688 A * 5/1984 Robins ..... A47G 1/168 248/494
4,597,554 A * 7/1986 James ..... A47G 1/1606 40/713
5,848,489 A * 12/1998 Hartley ..... A47G 1/0616 40/713
10,925,415 B1 * 2/2021 Butler ..... A47G 1/142
2009/0283657 A1 * 11/2009 Silvers ..... F16M 13/02 248/550
2016/0245455 A1 * 8/2016 Wartersian ..... A47G 29/08
2021/0048965 A1 * 2/2021 Frieder ..... G06V 20/30

* cited by examiner

*Primary Examiner* — David R Dunn
*Assistant Examiner* — Christopher E Veraa

(57) ABSTRACT

A self leveling picture frame assembly for automatically leveling a picture includes a picture frame defining a viewing space to display a picture. An insert is insertable into the picture frame to retain the picture in the picture frame. A leveling chamber is integrated into the insert and the leveling chamber contains a leveling fluid. The total quantity of leveling fluid is substantially less than a volume of the leveling chamber thereby facilitating the leveling fluid to travel freely in the leveling chamber. Moreover, the leveling fluid collects in the lowest point of the leveling chamber when the picture frame is hung on a vertical support surface. In this way the leveling fluid can level the picture frame on the vertical support surface.

6 Claims, 6 Drawing Sheets

SELF LEVELING PICTURE FRAME ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to picture frame devices and more particularly pertains to a new picture frame device for automatically leveling a picture frame. The device includes a picture frame and an insert that is insertable into the picture frame. The insert has a leveling chamber integrated into the insert and a leveling fluid is contained in the leveling chamber. The leveling fluid collects in the lowest point of the leveling chamber for leveling the picture frame on a vertical support surface.

(2) Description of Related Art Including Information Disclosed Under 37 CFR 1.97 and 1.98

The prior art relates to picture frame devices including a self hanging picture frame that has penetrating fasteners integrated into a picture frame for engaging a vertical support surface. The prior art discloses a variety of leveling tools each being employable for leveling a picture frame on a vertical support surface. The prior art discloses a picture frame leveling device that is mountable to a back of a picture frame and which automatically levels the picture frame via a gravity balanced pendulum.

BRIEF SUMMARY OF THE INVENTION

An embodiment of the disclosure meets the needs presented above by generally comprising a picture frame defining a viewing space to display a picture. An insert is insertable into the picture frame to retain the picture in the picture frame. A leveling chamber is integrated into the insert and the leveling chamber contains a leveling fluid. The total quantity of leveling fluid is substantially less than a volume of the leveling chamber thereby facilitating the leveling fluid to travel freely in the leveling chamber. Moreover, the leveling fluid collects in the lowest point of the leveling chamber when the picture frame is hung on a vertical support surface. In this way the leveling fluid can level the picture frame on the vertical support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
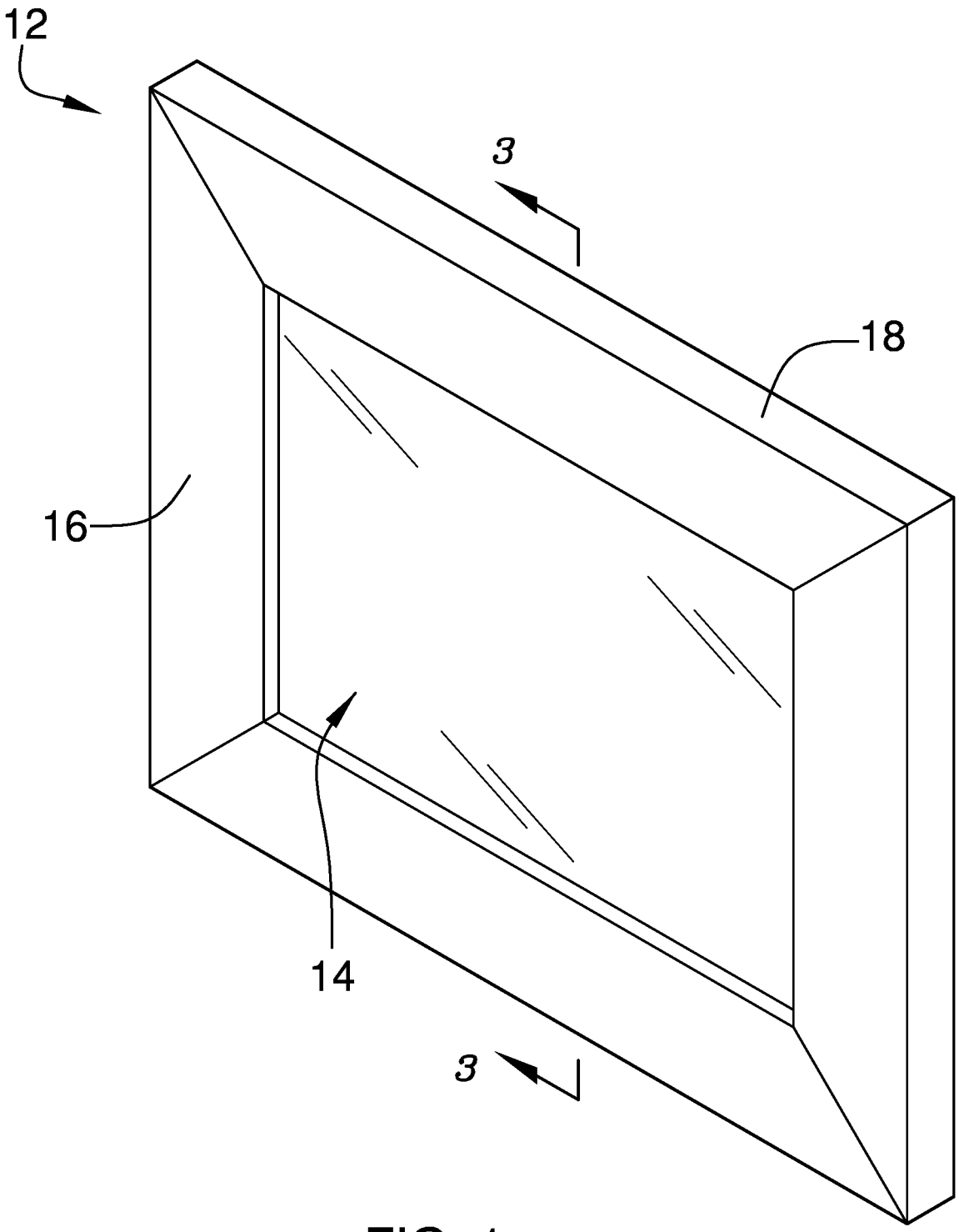
FIG. 1 is a front perspective view of a self leveling picture frame assembly according to an embodiment of the disclosure.
Figure 2:
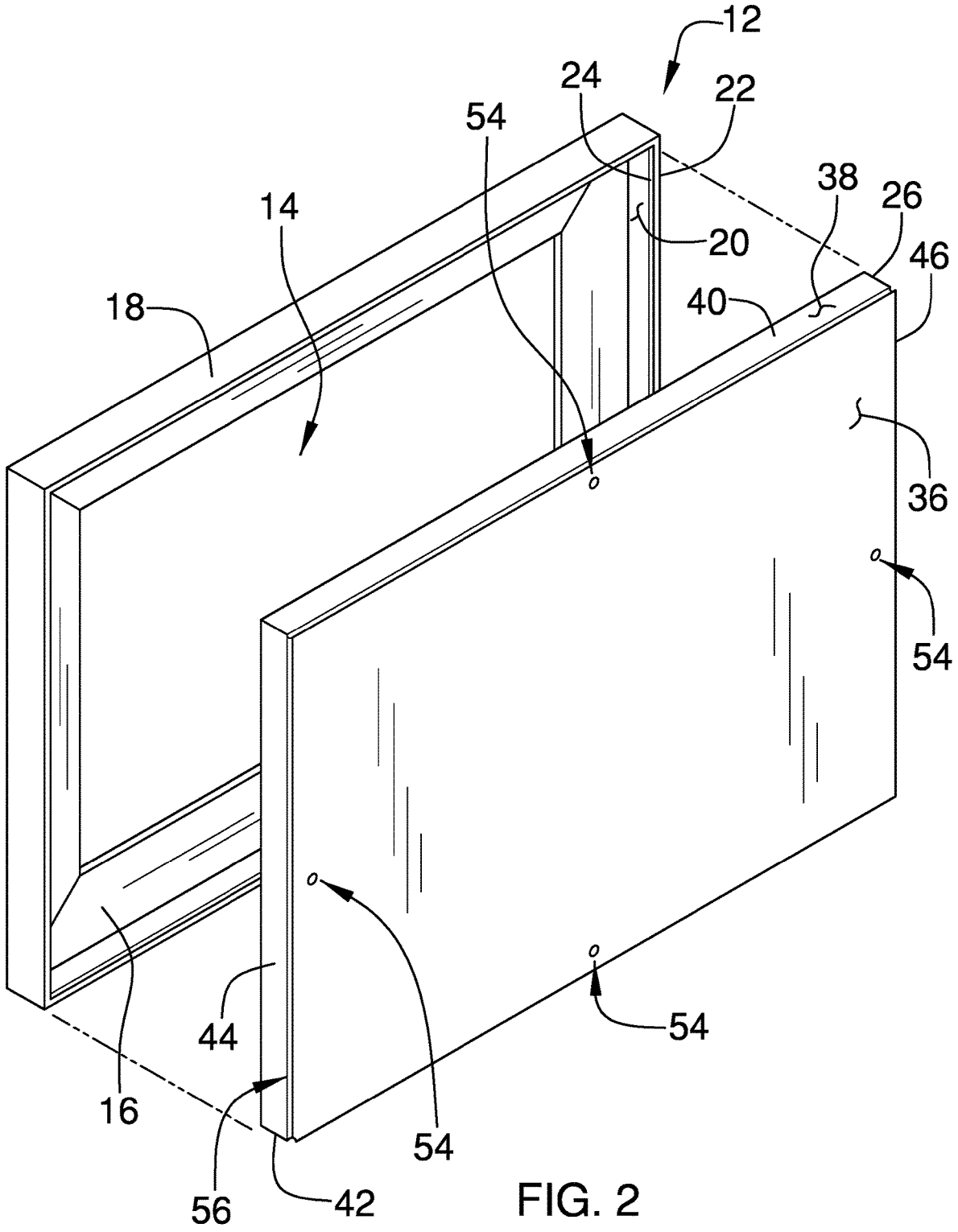
FIG. 2 is an exploded perspective view of an embodiment of the disclosure.
Figure 3:
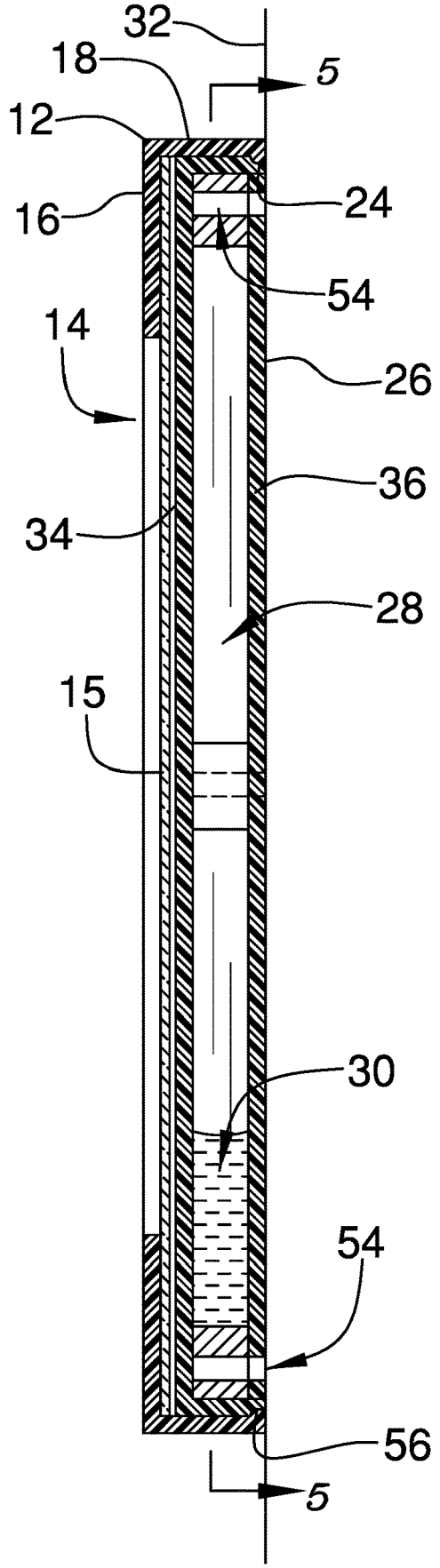
FIG. 3 is a cross sectional view taken along line 3-3 of FIG. 1 of an embodiment of the disclosure.
Figure 4:
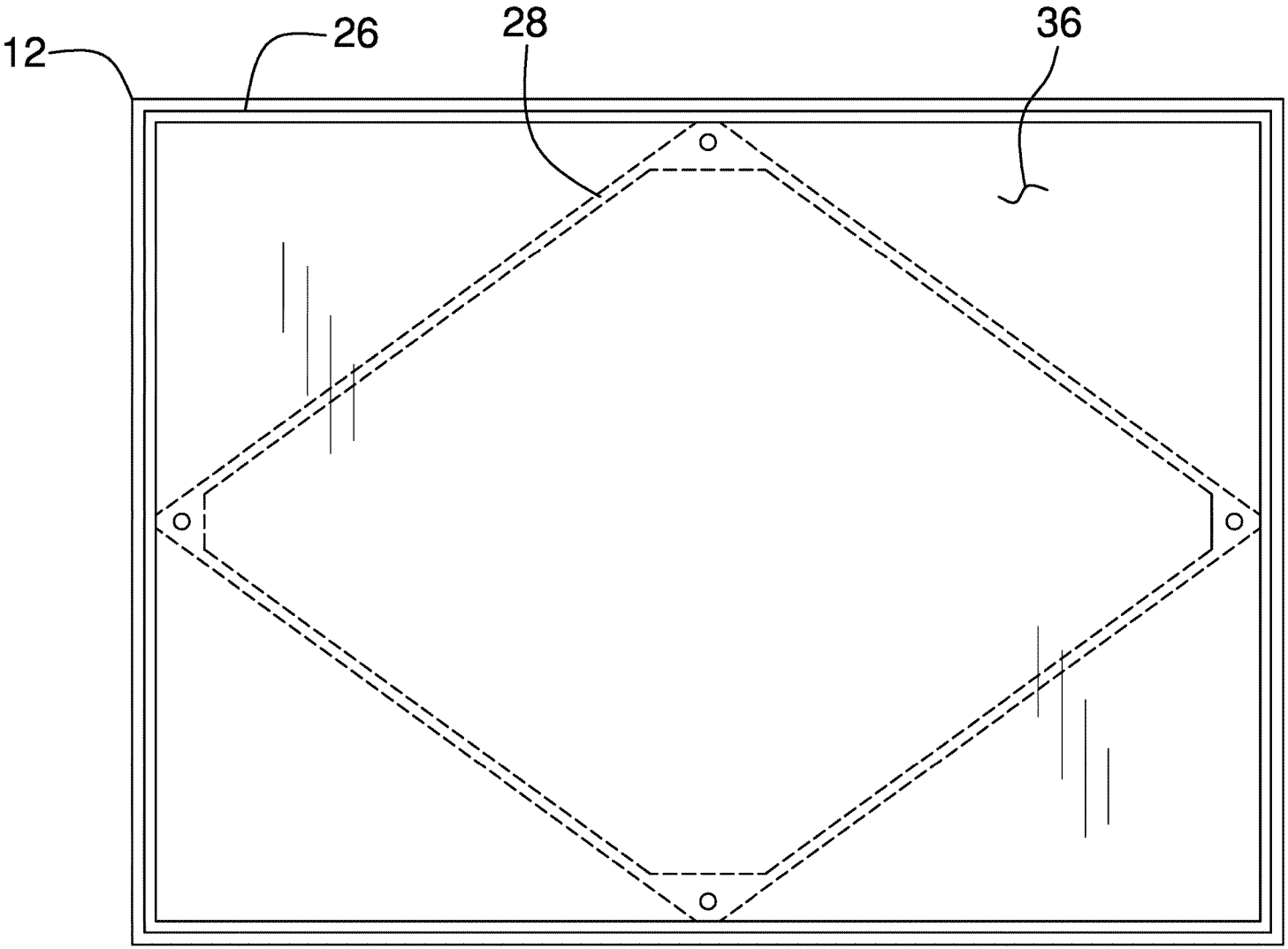
FIG. 4 is a back phantom view of an embodiment of the disclosure.
Figure 5:
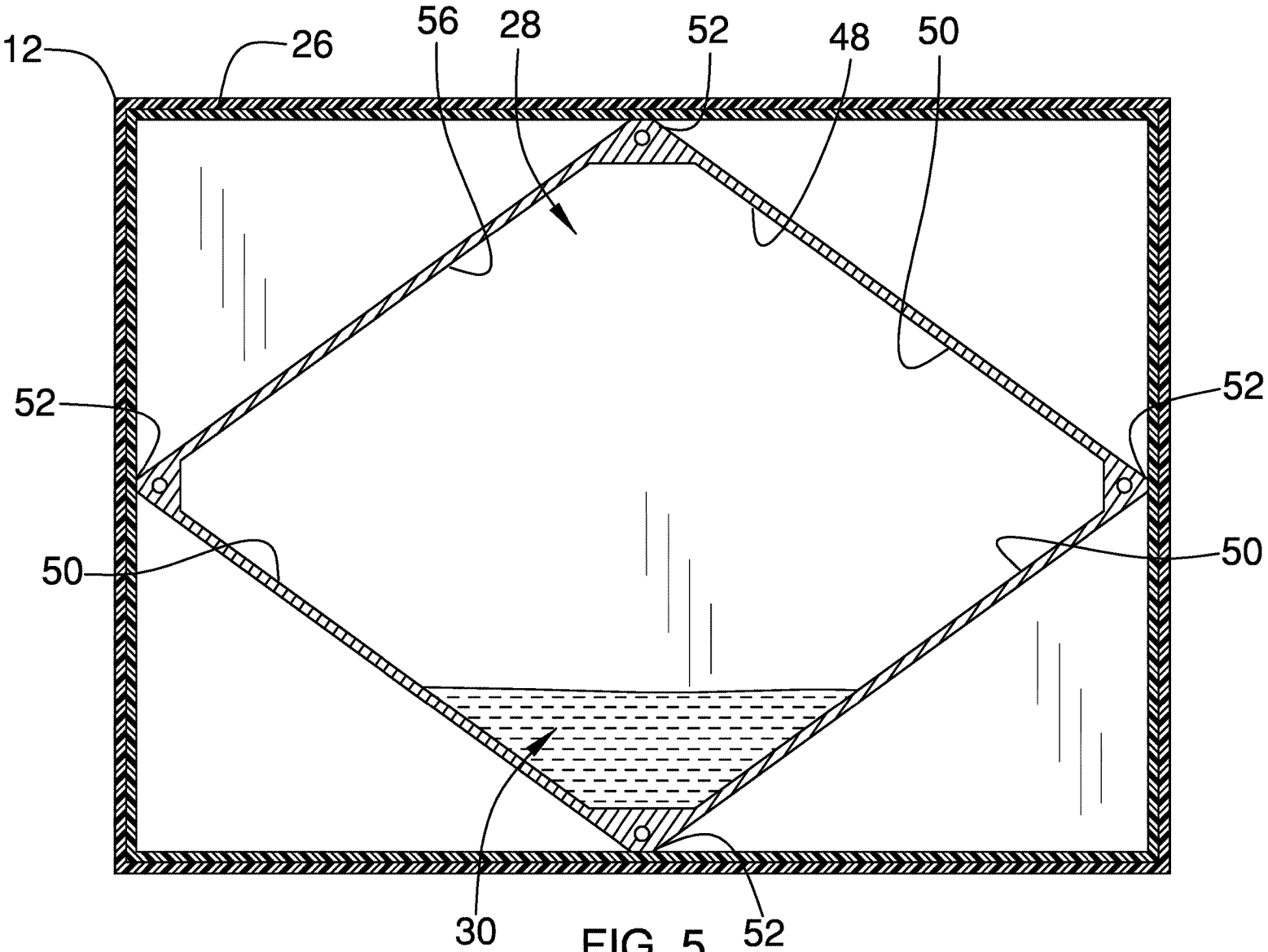
FIG. 5 is a cross sectional view taken along line 5-5 of FIG. 3 of an embodiment of the disclosure showing a picture frame in a landscape orientation.
Figure 6:
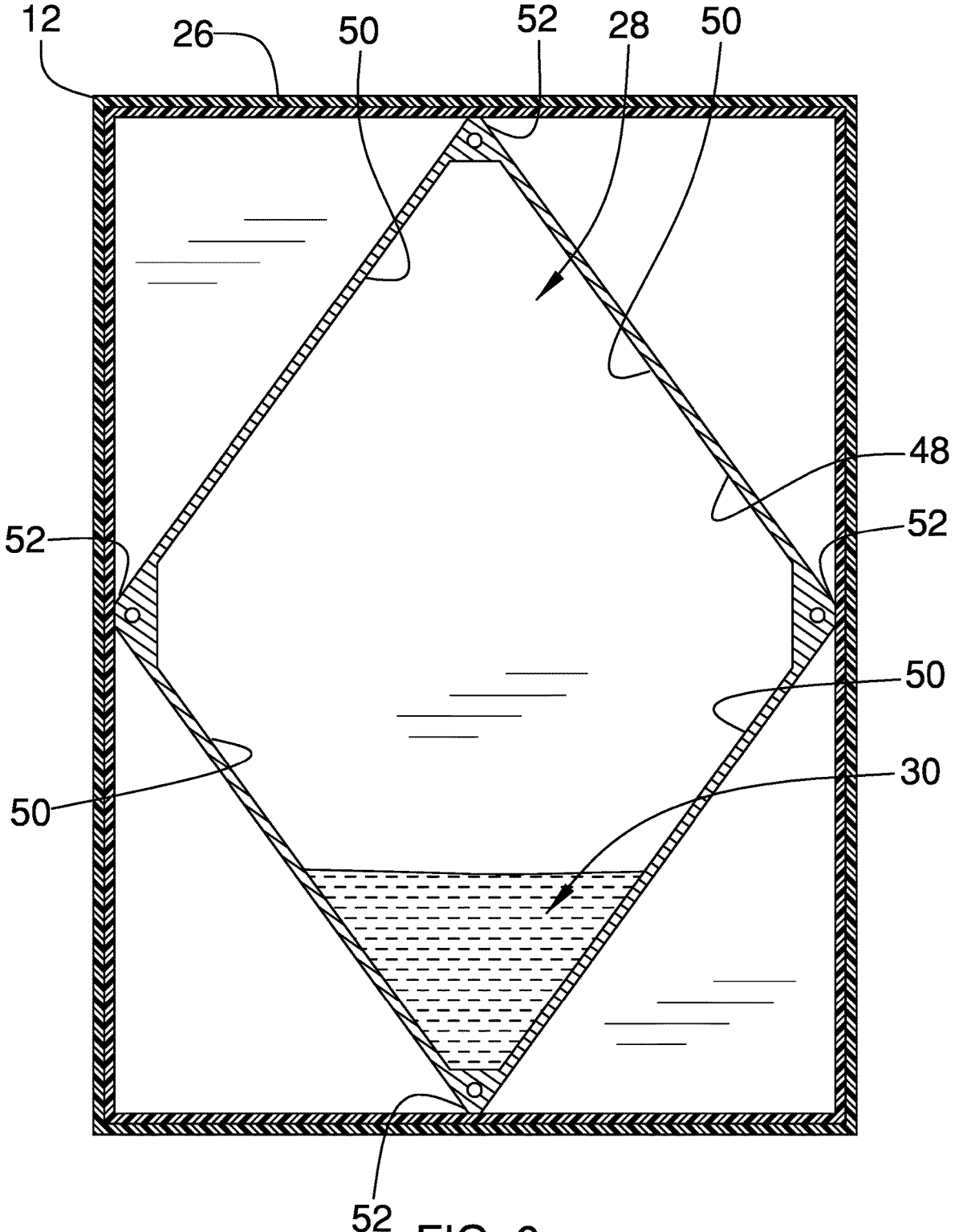
FIG. 6 is a cross sectional view taken along line 5-5 of FIG. 3 of an embodiment of the disclosure showing a picture frame in a portrait orientation.

With reference now to the drawings, and in particular to FIGS. 1 through 6 thereof, a new picture frame device embodying the principles and concepts of an embodiment of the disclosure and generally designated by the reference numeral 10 will be described.

As best illustrated in FIGS. 1 through 6, the self leveling picture frame assembly 10 generally comprises a picture frame 12 defining a viewing space 14 to display a picture 15. The picture frame 12 has a front wall 16 and a perimeter wall 18 extending away from the front wall 16, and the viewing space 14 is defined in the front wall 16. The perimeter wall 18 has an inwardly facing surface 20 and a distal edge 22 with respect to the front wall 16. The picture frame 12 has a lip 24 extending away from the inwardly facing surface 20 of the perimeter wall 18. Furthermore, the lip 24 extends around a full perimeter of the perimeter wall 18 and the lip 24 is positioned adjacent to the distal edge 22.

An insert 26 is provided and the insert 26 is insertable into the picture frame 12 to retain the picture 15 in the picture frame 12. A leveling chamber 28 is integrated into the insert 26 and the leveling chamber 28 contains a leveling fluid 30.

Moreover, the total quantity of the leveling fluid 30 is substantially less than a volume of the leveling chamber 28. In this way the leveling fluid 30 can travel freely in the leveling chamber 28. Furthermore, the leveling fluid 30 collects in the lowest point of the leveling chamber 28 when the picture frame 12 is hung on a vertical support surface 32. In this way the leveling fluid 30 levels the picture frame 12 on the vertical support surface 32. The leveling fluid 30 may comprise ethylene glycol or other fluid of a similar density and weight per fluid ounce.

The insert 26 has a forward surface 34, a rear surface 36 and a perimeter surface 38 extending between the forward surface 34 and the rear surface 36, and the perimeter surface 38 has a top side 40, a bottom side 42, a first lateral side 44 and a second lateral side 46. The leveling chamber 28 is positioned between the forward surface 34 and the rear surface 36. Additionally, the leveling chamber 28 has a bounding edge 48 and the bounding edge 48 has a plurality of intersecting sides 50 such that the leveling chamber 28 defines a parallelogram. The plurality of intersecting sides 50 interests at a plurality of points 52, and each of the points 52 is positioned along a respective one of the top side 40, the bottom side 42, the first lateral side 44 and the second lateral side 46 of the perimeter surface 38 of the insert 26. Additionally, each of the points 52 is centrally positioned along the respective top side 40, bottom side 42, first lateral side 44 and second lateral side 46. The leveling fluid 30 collects in a respective one of the points 52, depending on the orientation of the picture frame 12 on the vertical support surface 32.

The rear surface 36 has a plurality of wells 54 each extending toward the forward surface 34 to receive a nail in the vertical support surface 32 for suspending the insert 26 on the vertical support surface 32. Each of the wells 54 is positioned adjacent to a respective one of the top side 40, the bottom side 42, the first lateral side 44 and the second lateral side 46 of the perimeter surface 38 of the insert 26. A channel 56 is recessed into the perimeter surface 38 of the insert 26 and the channel 56 extends along each of the top side 40, the bottom side 42, the first lateral side 44 and the second lateral side 46. The channel 56 insertably receives the lip 24 on the inwardly facing surface 20 of the perimeter wall 18 of the picture frame 12 when the insert 26 is positioned in the picture frame 12 for retaining the insert 26 in the picture frame 12.

In use, the insert 26 is positioned in the picture frame 12 such that the lip 24 engages the recess for retaining the insert 26 in the picture frame 12. The picture frame 12 is suspended on the vertical support surface 32 and the leveling fluid 30 collects in which ever point in the leveling chamber 28 is pointing downwardly. In this way the mass of the leveling fluid 30 automatically levels the picture frame 12 on the vertical support surface 32. Thus, the picture frame 12 remains in a level orientation on the vertical support surface 32 without the need to be checked or adjusted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A self leveling picture frame assembly for leveling a picture on a vertical support surface, said assembly comprising:

a picture frame defining a viewing space wherein said viewing space is configured to display a picture; and an insert being insertable into said picture frame wherein said insert is configured to retain the picture in said picture frame, said insert having a leveling chamber being integrated into said insert, said leveling chamber containing a leveling fluid of a quantity being substantially less than a volume of said leveling chamber thereby facilitating said leveling fluid to travel freely in said leveling chamber, said leveling fluid collecting in the lowest point of said leveling chamber when said picture frame is hung on a vertical support surface wherein said leveling fluid is configured to level said picture frame on the vertical support surface.

2. The assembly according to claim 1, wherein said picture frame has a front wall and a perimeter wall extending away from said front wall, said viewing space being defined in said front wall, said perimeter wall having an inwardly facing surface and a distal edge with respect to said front wall, said picture frame having a lip extending away from said inwardly facing surface of said perimeter wall, said lip extending around a full perimeter of said perimeter wall, said lip being positioned adjacent to said distal edge.

3. The assembly according to claim 1, wherein:

said insert has a forward surface, a rear surface and a perimeter surface extending between said forward surface and said rear surface, said perimeter surface having a top side, a bottom side, a first lateral side and a second lateral side; and said leveling chamber is positioned between said forward surface and said rear surface, said leveling chamber having a bounding edge, said bounding edge having a plurality of intersecting sides such that said leveling chamber defines a parallelogram, said plurality of intersecting sides interesting at a plurality of points, each of said points being positioned along a respective one of said top side, said bottom side, said first lateral side and said second lateral side of said perimeter surface of said insert.

4. The assembly according to claim 3, wherein said rear surface has a plurality of wells each extending toward said forward surface wherein a respective one of said wells is configured to receive a nail in the vertical support surface for suspending said insert on the vertical support surface, each of said wells being positioned adjacent to a respective one of said top side, said bottom side, said first lateral side and said second lateral side of said perimeter surface of said insert.

5. The assembly according to claim 3, wherein:

said picture frame has a perimeter wall, said perimeter wall having an inwardly facing surface, said picture frame having a lip extending away from said inwardly facing surface of said perimeter wall, said lip extending around a full perimeter of said perimeter wall, said lip being positioned adjacent to said distal edge;

said perimeter surface of said insert has a channel being recessed into said perimeter surface, said channel extending along each of said top side, said bottom side, said first lateral side and said second lateral side, said channel insertably receiving said lip on said inwardly facing surface of said perimeter wall of said picture frame when said insert is positioned in said picture frame for retaining said insert in said picture frame.

6. A self leveling picture frame assembly for leveling a picture on a vertical support surface, said assembly comprising:

a picture frame defining a viewing space wherein said viewing space is configured to display a picture, said picture frame having a front wall and a perimeter wall extending away from said front wall, said viewing space being defined in said front wall, said perimeter wall having an inwardly facing surface and a distal edge with respect to said front wall, said picture frame having a lip extending away from said inwardly facing surface of said perimeter wall, said lip extending around a full perimeter of said perimeter wall, said lip being positioned adjacent to said distal edge; and an insert being insertable into said picture frame wherein said insert is configured to retain the picture in said picture frame, said insert having a leveling chamber being integrated into said insert, said leveling chamber containing a leveling fluid of a quantity being substantially less than a volume of said leveling chamber thereby facilitating said leveling fluid to travel freely in said leveling chamber, said leveling fluid collecting in the lowest point of said leveling chamber when said picture frame is hung on a vertical support surface wherein said leveling fluid is configured to level said picture frame on the vertical support surface, said insert having a forward surface, a rear surface and a perimeter surface extending between said forward surface and said rear surface, said perimeter surface having a top side, a bottom side, a first lateral side and a second lateral side, said leveling chamber being positioned between said forward surface and said rear surface, said leveling chamber having a bounding edge, said bounding edge having a plurality of intersecting sides such that said leveling chamber defines a parallelogram, said plurality of intersecting sides interesting at a plurality of points, each of said points being positioned along a respective one of said top side, said bottom side, said first lateral side and said second lateral side of said perimeter surface of said insert, said rear surface having a plurality of wells each extending toward said forward surface wherein a respective one of said wells is configured to receive a nail in the vertical support surface for suspending said insert on the vertical support surface, each of said wells being positioned adjacent to a respective one of said top side, said bottom side, said first lateral side and said second lateral side of said perimeter surface of said insert, said perimeter surface having a channel being recessed into said perimeter surface, said channel extending along each of said top side, said bottom side, said first lateral side and said second lateral side, said channel insertably receiving said lip on said inwardly facing surface of said perimeter wall of said picture frame when said insert is positioned in said picture frame for retaining said insert in said picture frame.

* * * * *